US006324820B1

(12) United States Patent
Gelfman et al.

(10) Patent No.: US 6,324,820 B1
(45) Date of Patent: Dec. 4, 2001

(54) SPOOL TRANSFER COIL WRAPPING MACHINE

(75) Inventors: Roman Gelfman, New Britain; Spanakos Chris, Wolcott, both of CT (US); Melvin G. Parnes, Milford, NJ (US)

(73) Assignee: Intergrated Industrial Systems, Inc., Yalesville, CT (US)

( * ) Notice: Subject to any disclaimer, the term of this patent is extended or adjusted under 35 U.S.C. 154(b) by 0 days.

(21) Appl. No.: 09/533,307

(22) Filed: Mar. 23, 2000

(51) Int. Cl.[7] ..... B65B 27/06; B65B 13/02
(52) U.S. Cl. ..... 53/588; 53/399; 53/204
(58) Field of Search ..... 53/203, 204, 399, 53/588

(56) References Cited

U.S. PATENT DOCUMENTS

| | | | | |
|---|---|---|---|---|
| 3,168,032 | | 2/1965 | Faulkner | 100/12 |
| 4,230,519 | | 10/1980 | DuBroff | 156/468 |
| 4,829,753 | | 5/1989 | Briemont | 53/588 |
| 5,079,899 | * | 1/1992 | Kurachi . | |
| 5,282,347 | | 2/1994 | Cleine et al. | 53/204 |
| 5,404,691 | * | 4/1995 | Scherer . | |
| 5,540,142 | | 7/1996 | Mieleszuk et al. | 100/4 |
| 5,560,180 | * | 10/1996 | Rodriguez et al. . | |
| 5,755,083 | * | 5/1998 | Cleine . | |

* cited by examiner

*Primary Examiner*—Eugene Kim
(74) *Attorney, Agent, or Firm*—Pearne & Gordon LLP

(57) ABSTRACT

A wrapping machine for wrapping a generally toroidal body having an opening therethrough with an elongated length of wrapping material has supports for a body to be wrapped with the central axis of the opening through the body in a predetermined position and a shuttle for carrying a spool of wrapping material and for the controlled dispensing of the wrapping material. A wrapping frame has four transfer assemblies arranged in a generally rectangular array, one of the transfer assemblies being positionable through the opening in the body. The transfer assemblies include first and second transfer assemblies each having rails for receiving the shuttle at one end and conveying the shuttle to the opposite end, the first and second transfer assemblies being positioned at opposite sides of the rectangular array. Third and fourth transfer assemblies each have a shuttle carrier and means for conveying the shuttle carrier from one end of the transfer assembly to the other end thereof, the third and fourth transfer assemblies being positioned at opposite sides of the rectangular array and interconnecting ends of the first and second transfer assemblies. The shuttle carriers are each adapted to receive a shuttle from the rails of one of the first and second transfer assemblies, carry the shuttle along the length of one of the third and fourth transfer assemblies and release the shuttle to the rails of the other of the first and second transfer assemblies for conveyance to the carrier on the other one of the third and fourth transfer assemblies while dispensing wrapping material to wrap the coil.

13 Claims, 6 Drawing Sheets

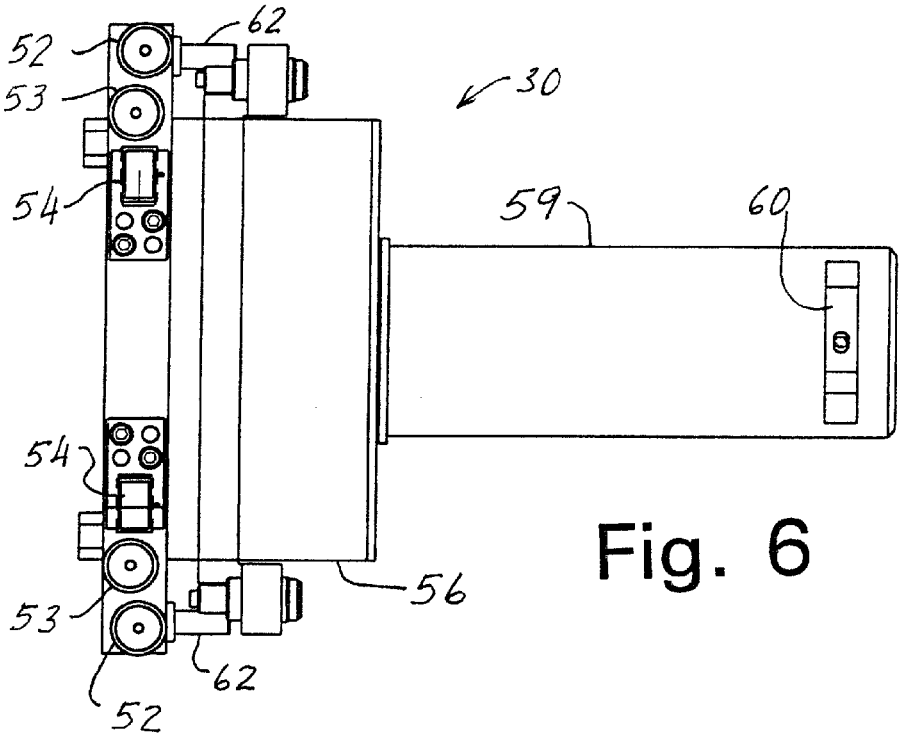
Fig. 6
Fig. 7
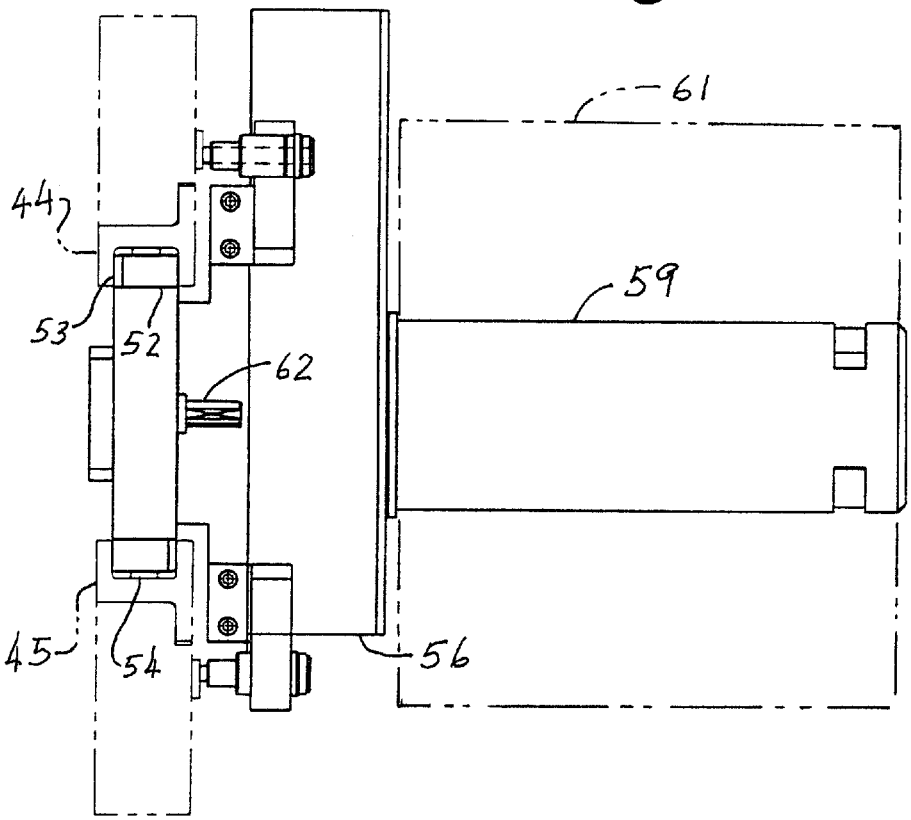

SPOOL TRANSFER COIL WRAPPING MACHINE

FIELD OF THE INVENTION

This invention relates to a machine for wrapping a web of paper or film around an endless coil or the like, particularly a coil of metal strip, and to such a machine which transfers a web spool from one portion of the machine to another.

BACKGROUND OF THE INVENTION

It is well known to make a machine for the purpose of wrapping an electrical coil, a coil of metal strip or the like with paper or film which can be stretchable film. The paper or film performs insulating and protective functions without interfering with the operation of the coil, if it is an electrical coil, in a motor or other apparatus. The article to be wrapped is generally toroidal, i.e., it is usually a circular or rectangular article with a hole or eye through the middle and the objective is to wrap the film or paper through the eye so that it covers the torus without blocking the hole.

Some such machines of the prior art use a traveling spool which carries the wrapping material (hereinafter generically referred to as "film") around a generally circular track which has an opening to permit engagement of the track with the torus. A portion of the track can be moved or removed so that the track can be inserted partially through the opening, after which the moved portion of the track is replaced.

While this system works reasonably well, manufacture of the track and its support structure, which is usually oval or circular, presents some special problems which make the manufacture difficult and expensive.

SUMMARY OF THE INVENTION

An object of the invention is to provide a machine for coil wrapping which permits the use of individual essentially straight members to support and transport one or more rolls or spools of film or paper around a coil through the eye of the coil with the moving spool or spools being transferred from one straight member to another as the coil is wrapped.

Briefly described, the invention comprises a wrapping machine for wrapping a generally toroidal body having an opening therethrough with an elongated length of wrapping material. The machine includes means for supporting a body to be wrapped with the central axis of the opening through the body in a predetermined position and a shuttle for carrying a spool of wrapping material and for the controlled dispensing of said wrapping material. A wrapping frame has four transfer assemblies arranged in a generally rectangular array, one of the transfer assemblies being positionable through the opening in the body. The transfer assemblies include first and second transfer assemblies each having rails for receiving the shuttle at one end and conveying the shuttle to the opposite end, the first and second transfer assemblies being positioned at opposite sides of the rectangular array. Third and fourth transfer assemblies each have a shuttle carrier and means for conveying the shuttle carrier from one end of the transfer assembly to the other end thereof, the third and fourth transfer assemblies being positioned at opposite sides of the rectangular array and interconnecting ends of the first and second transfer assemblies. The shuttle carriers are each adapted to receive a shuttle from the rails of one of the first and second transfer assemblies, carry the shuttle along the length of one of the third and fourth transfer assemblies and release the shuttle to the rails of the other of the first and second transfer assemblies for conveyance to the carrier on the other one of the third and fourth transfer assemblies while dispensing wrapping material to wrap the coil.

BRIEF DESCRIPTION OF THE DRAWINGS

In order to impart full understanding of the manner in which these and other objects are attained in accordance with the invention, a particularly advantageous embodiment thereof will be described with reference to the following drawings, which form a part of this disclosure, and wherein:

FIGS. 6 and 7 are top plan and side elevation views, respectively, of a shuttle and film roll support usable in the apparatus of FIGS. 1–3;

DESCRIPTION OF PREFERRED EMBODIMENTS

Figure 1:
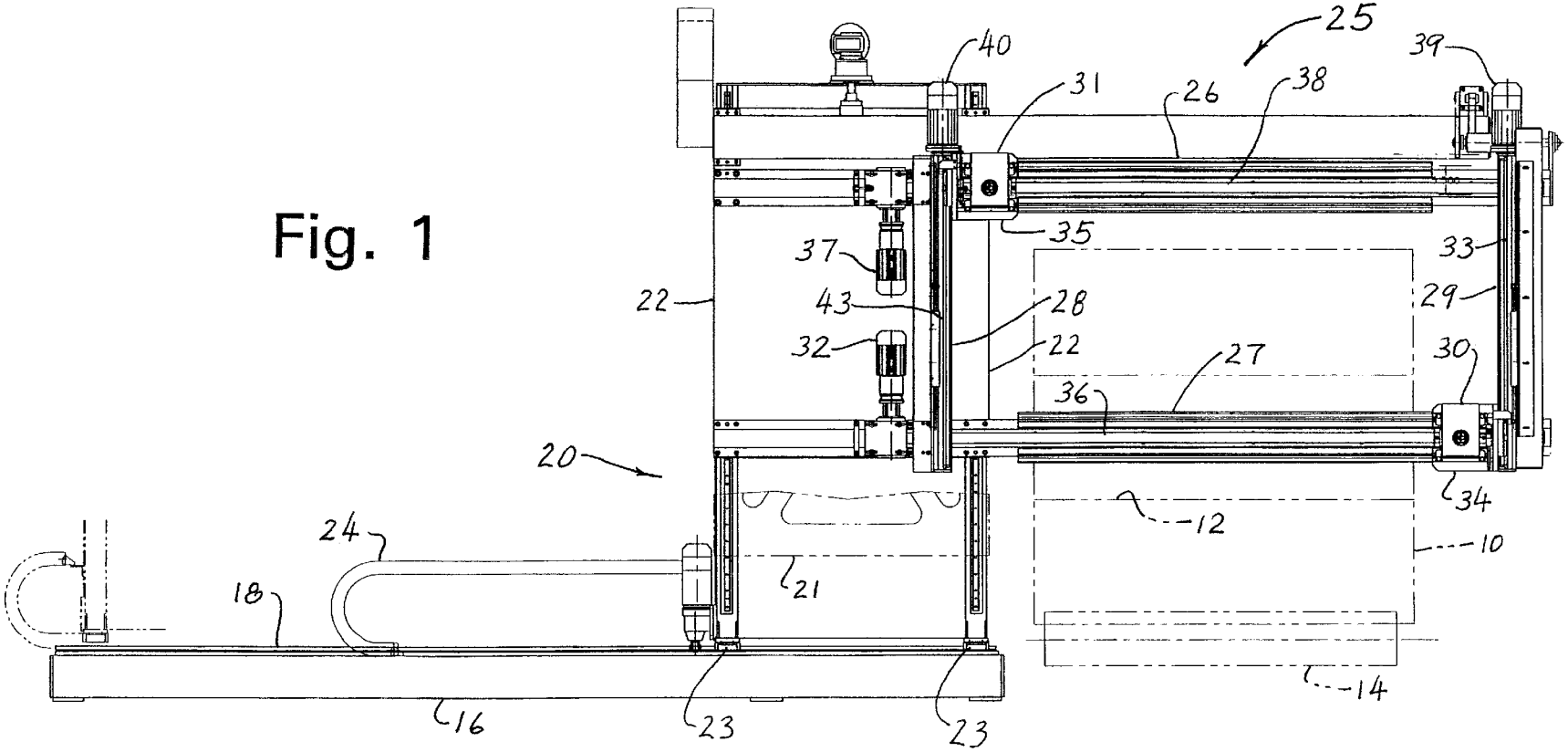
FIG. 1 is a front elevation of a preferred embodiment of an apparatus in accordance with the invention with two film shuttles.
Figure 2:
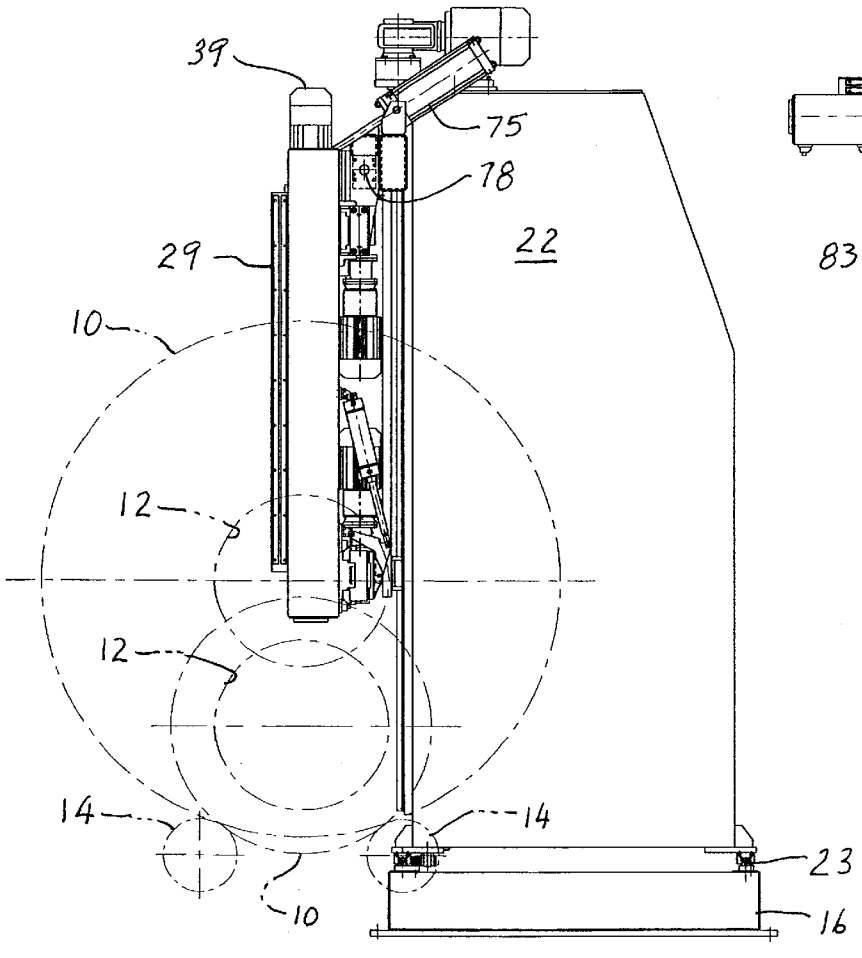

FIGS. 1 and 2 show a first embodiment of a coil wrapping apparatus for the purpose of wrapping a paper or film around a coil. It will be understood that the coil itself is not part of the present invention and that many different kinds of coils or other generally toroidal bodies can be wrapped using machines based on the principles of the apparatus disclosed herein. For purposes of example, a coil 10 is shown in phantom lines as being a generally toroidal coil having a generally cylindrical central opening or eye 12 coaxial with the body of the coil itself. While the shape of the coil is not critical to use of the invention, it is important that the toroidal body have a central opening large enough to permit insertion of part of the apparatus.

Means for supporting, transporting and manipulating the coil typically includes a pair of driven supporting rolls 14 on which coil 10 rests. A motor drive, which is generally conventional and is not shown, is coupled to rolls 14 to rotate the rolls in a predetermined direction, or bidirectionally, about their own axes in a selectable direction and at a rate of speed which is determined by various factors such as the speed of the winding mechanism, to be described, the size and weight of the coil, the desired size and overlap of the wrapping, and the like.

Figure 3:
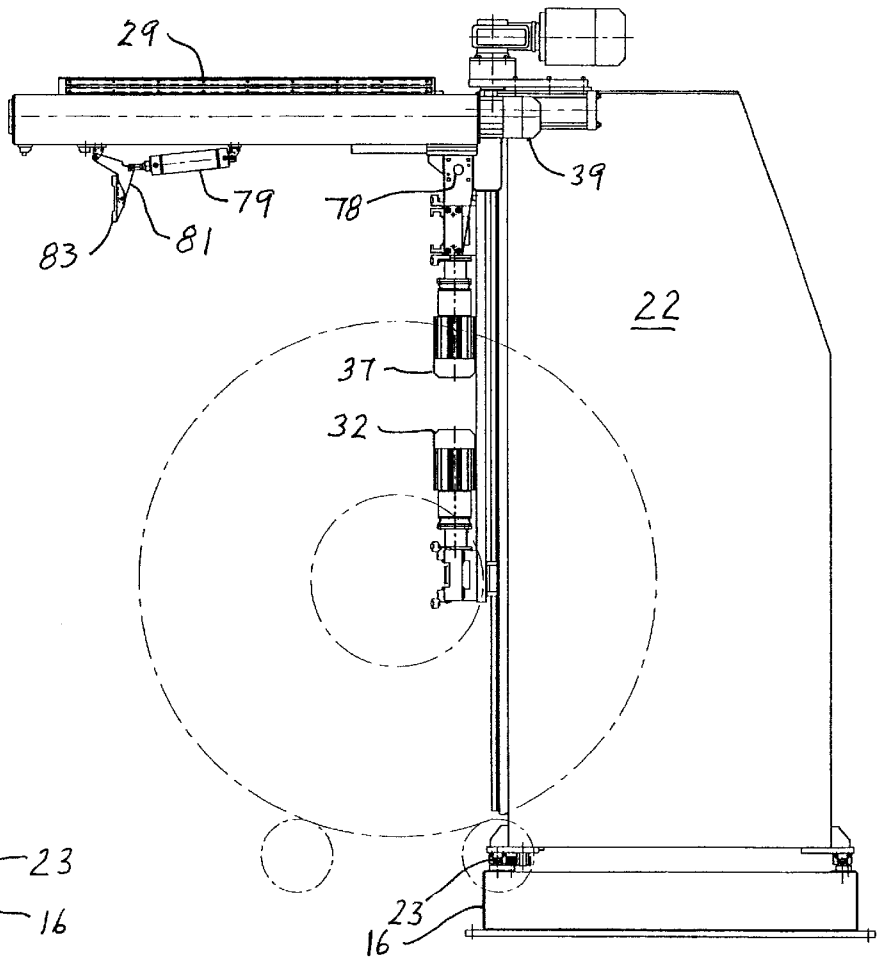
FIGS. 2 and 3 are right side elevation of the apparatus of FIG. 1, FIG. 2 having the frame closed and FIG. 3 showing a side of the frame open for insertion into a coil to be wrapped.

The wrapping apparatus, in the embodiment shown in FIGS. 1, 2 and 3, comprises a generally rectangular base 16 having front and back linear rails 18 at the upper edges thereof. A support trolley 20 includes a back frame 21 and two vertical side walls 22 having rollers 23 at their lower ends to ride on rails 18, two of the rollers riding on each of the front and back rails. Walls 22 support the actual wrapping mechanism and are movable along rails 18 a distance of about ten feet to facilitate coupling the wrapping mechanism to the coil to be wrapped. An electrical cable 24 provides power to the moving trolley assembly and is sufficiently flexible to follow as the trolley moves.

A rectangular wrapping frame 25 including two horizontal transfer assemblies 26 and 27 and two vertical transfer assemblies 28 and 29 is supported on the side walls of trolley 20. Each horizontal transfer assembly has a belt drive to convey a shuttle from one end of the horizontal span to the other. The vertical transfer assemblies each have a ball screw drive to engage and raise or lower a carrier and shuttle from one end thereof to the other. The frame can be raised and lowered as a whole along the side walls to accommodate coil eyes at various heights. It would be possible to design a mechanism which operates in a manner similar to the present invention but with the frame in a horizontal plane rather than a vertical plane. However, for reasons of strength and ease of vertical adjustment, arranging the frame so that it hangs somewhat like a picture frame has proven to be the most efficient embodiment.

Before discussing the mechanical and electrical features of the assembly in any more detail, it will be helpful to briefly discuss the operation of the overall apparatus.

Upper and lower horizontal transfer assemblies 26 and 27 are substantially the same as each other. Left and right vertical transfer assemblies 28 and 29 are similar to each other in most respects but assembly 29 differs in that it is swingable from the position shown in FIGS. 1 and 2, where it lies in a plane parallel with the plane of the FIG. 1 drawing, outwardly and upwardly to the position shown in FIG. 3. In the open position of FIG. 3, lower transfer assembly 27 can be inserted into the eye of the coil to be wrapped by adjusting the height of the frame and moving trolley 20 from left to right (as shown in FIG. 1), after which assembly 29 is closed and latched and the apparatus is in position for wrapping. It will be observed that the central axis of the coil eye is parallel with planes containing the vertical and horizontal transfer assemblies.

The apparatus of FIG. 1 has two shuttles 30 and 31 which are conveyed repeatedly around paths defined by the horizontal and vertical assemblies while the coil to be wrapped is rotated about its own axis, leaving overlapping wound layers of film on part of the coil with each shuttle cycle. Each shuttle has a spindle which carries a roll of film, as will be described hereinafter.

Considering first the movement of shuttle 30, the shuttle can be regarded as starting a cycle from the right end of lower assembly 27. The apparatus can be operated such that it travels in either a clockwise or counter-clockwise direction, but a counter-clockwise direction will be used for this example. At that point, the shuttle is latched to a carrier 34 which is connected to linear actuator 33, such as a ball screw mechanism, on vertical transfer assembly 29. Linear actuator 33 is driven by an electric motor 39 in a direction to elevate carrier 34 and, with it, shuttle 30, until the carrier reaches the end of its travel at upper transfer assembly 26.

When carrier 34 and shuttle 30 reach transfer assembly 26, the shuttle is coupled to an endless drive belt 38 extending along assembly 26 and is released from carrier 34. After the shuttle leaves the carrier, the carrier returns to its starting position. Belt 38 is driven by an electric motor 37 mounted on assembly 26 to the left of vertical assembly 28. Shuttle 30 has wheels which ride on rails extending along the upper and lower edges of assembly 26 and which keep the shuttle from leaving the rails. Belt 38 drives shuttle 30 to the left toward assembly 28.

Meanwhile, shuttle 31 is attached to a carrier 35 mounted on linear actuator 43 of vertical transfer assembly 28 and is lowered until it reaches the end of its travel at lower transfer assembly 27. After shuttle 31 leaves the carrier, carrier 35 is returned to its uppermost position.

When shuttle 30 reaches left vertical transfer assembly 28, the shuttle engages and is latched to carrier 35 on linear actuator 43 driven by a motor 40 on assembly 28. Shuttle 30 is then moved downwardly until it reaches lower transfer assembly 27.

Carrier 35 releases shuttle 30 which engages an endless drive belt 36, driven by motor 32, and is moved to the right along assembly 27 until the shuttle is transferred to carrier 34 on linear actuator 33 on vertical assembly 29. These steps repeat themselves until the coil has been wrapped adequately, whereupon the apparatus is stopped, assembly 29 is swung out of its closed position, trolley 20 moves to the left to separate the wrapping mechanism from the wrapped coil, the wrapped coil is removed and a new coil to be wrapped is put into position.

Figure 4:
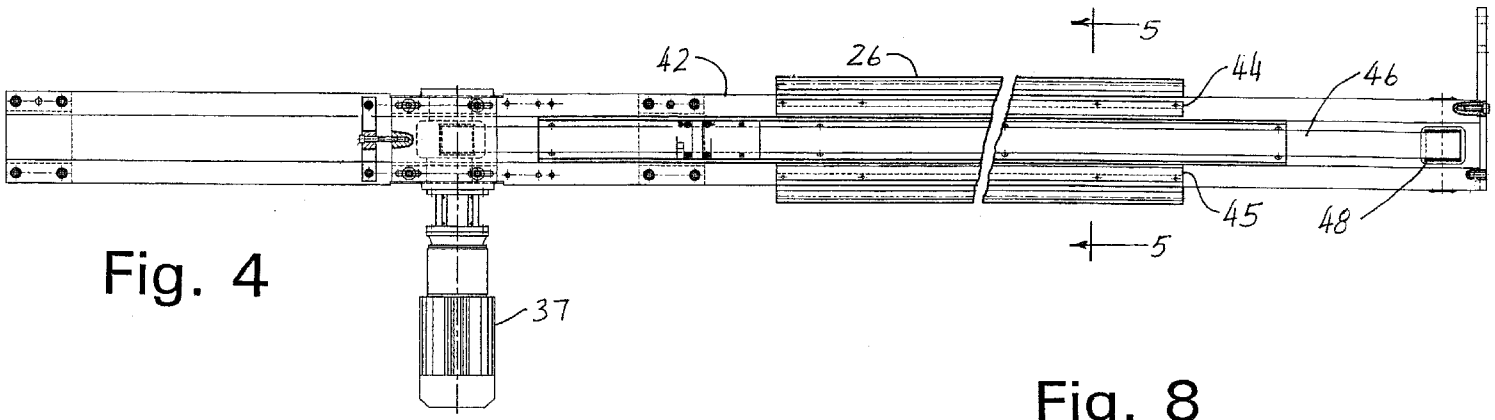
FIG. 4 is a side elevation of an upper horizontal transfer assembly of the apparatus of FIGS. 1–3.
Figure 5:
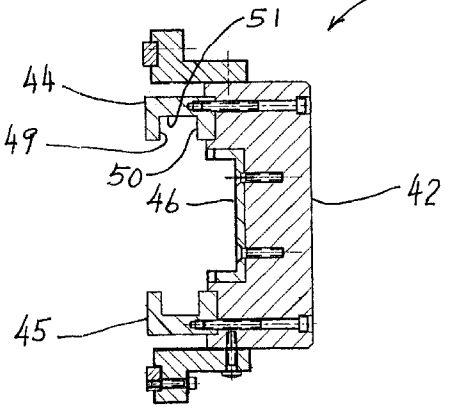
FIG. 5 is an enlarged sectional view along line 5—5 of FIG. 4.

Horizontal transfer assembly 26 is shown in more detail in FIGS. 4 and 5. Since assembly 26 is functionally identical to 27, and structurally very similar, only assembly 26 will be described in detail.

Assembly 26 includes an elongated beam 42 which carries upper and lower stationary rails 44 and 45 on which shuttle wheels ride. Each of the rails has three inwardly facing contact surfaces 49, 50 and 51, best seen in FIG. 5, against which wheels of the shuttle ride, as will be explained. It will be noted that rails 44 and 45 are shorter than beam 42, leaving space at the ends for positioning of carriers 34 and 35 by the linear actuators of the vertical transfer assemblies. A belt support 46 is centrally located between rails 44 and 45 on beam 42, belt 38 being omitted from FIGS. 4 and 5. Near the right end of beam 42 is a pulley 48 around which belt 38 can pass in the final assembly, the other support for the belt being an identical pulley and shaft coupled to the shaft of drive motor 37.

Figure 8:
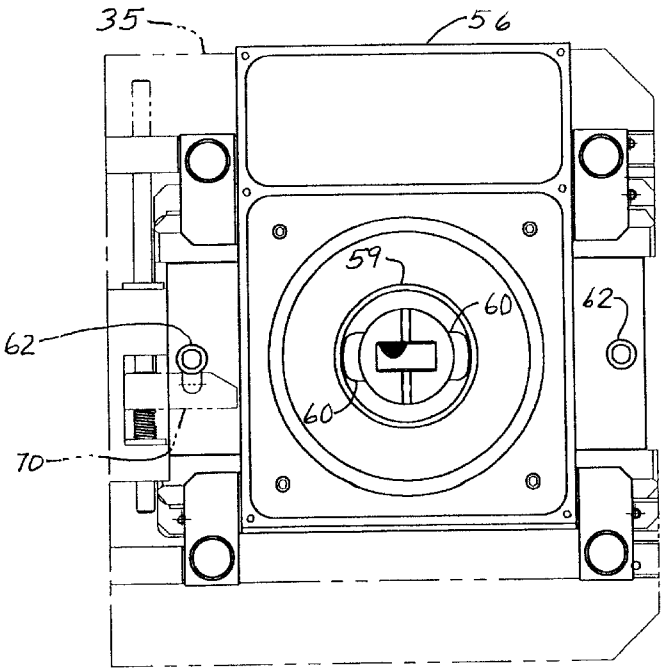
FIG. 8 is an end elevation of the shuttle of FIGS. 6 and 7 with part of a carrier.

Shuttle 30 which rides on the rails of the upper and lower transfer assemblies, and which is lifted and lowered with the carriers on the vertical transfer assemblies, is shown in FIGS. 6, 7 and 8. The shuttle has a base with twelve wheels in four sets of three which ride on the rails in such a way that the shuttle is held in a definite position relative to the rails. As seen in FIG. 6, a set of wheels includes wheels 52 and 53 which are freely rotatable about parallel axes which are offset from each other so that the peripheral surfaces of the wheels engage opposite parallel surfaces of the track. A third wheel 54 in each set rotates about an axis which is perpendicular to the axes of wheels 52 and 53 so that wheel 54 rides on a surface perpendicular to and between the other two surfaces. As mentioned above, each rail is generally U-shaped and has three inwardly facing contact surfaces. Two of those contact surfaces 49 and 50 are parallel with each other and the third surface 51 is perpendicular and extends between the parallel surfaces. Wheels 52 and 53 ride on surfaces 49 and 50 while the third wheel 54 rides against surface 51. Portions of the rails are shown in FIG. 7 with the wheels in contact therewith. Each of the four sets of wheels makes contact in this manner so that the shuttle is securely positioned.

Attached to the shuttle base is a motor and control housing 56 and a roll support 58 which holds a roll of film, indicated in phantom lines at 61, to be dispensed. Roll support 58 comprises a spindle 59 on which a film roll is mounted, the roll being held by latches 60 which are moved outwardly to engage inner surfaces of the roll after it is loaded onto the spindle. The spindle is mounted on an internal shaft which is rotatable relative to the shuttle and the motor housing, the internal shaft being connected to the shaft of the motor, not separately shown, which is inside the housing. The motor in housing 56 rotates spindle 59 at a controlled speed which allows dispensing of the film at a desired rate as a function of the speed of movement of the shuttle around the coil being wrapped and maintains tension in the departing film so that it is stretched as it is being dispensed.

Figure 10:
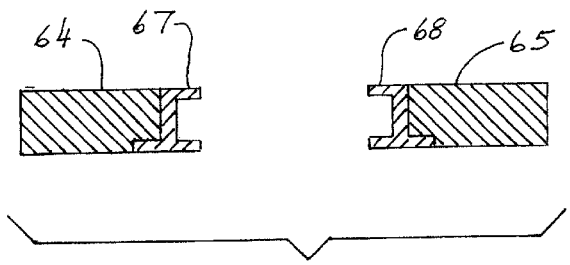
FIG. 10 is a sectional view of a portion of the carrier of FIG. 9 along line 10—10.
Figure 9:
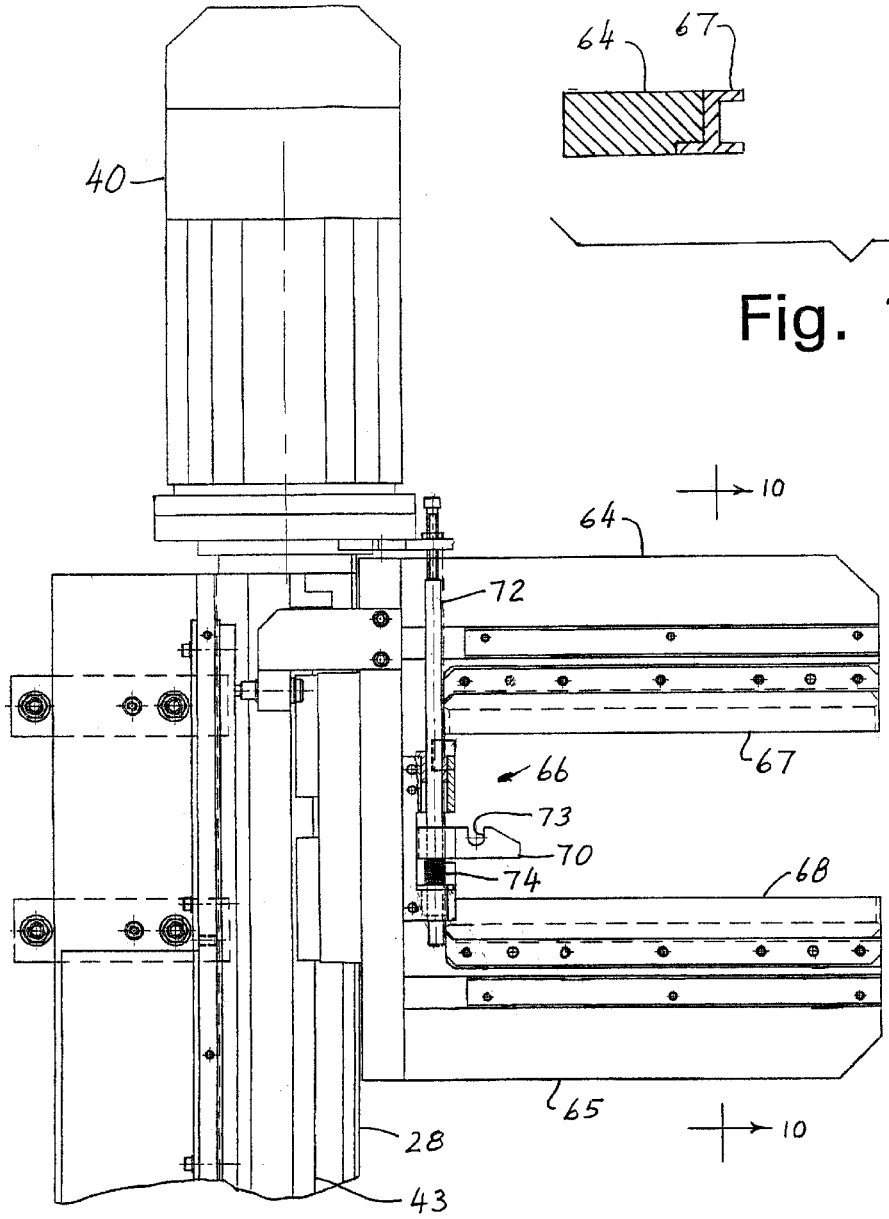
FIG. 9 is a front elevation of-an upper portion of a vertical transfer assembly with a carrier.

Before completing the description of the shuttle, attention is invited to FIG. 9 which shows an enlarged partial view of vertical transfer assembly 28 and carrier 35, and FIG. 10 which is a sectional view of the carrier. Carrier 34 is identical to carrier 35. The carrier comprises a generally U-shaped body having arms 64 and 65 and a base portion 66. The arms have rails 67 and 68 each of which is U-shaped, as seen in FIG. 10, and are dimensioned to be the same shape and size as rails 44 and 45 along transfer assembly 26. When carrier 35 is at the top of vertical transfer assembly 28 as shown in FIG. 1, rails 67 and 68 form continuations of rails 44 and 45 and the carrier can then act as a docking station to receive shuttle 30 or 31 when belt 38 delivers it.

Carrier 35 has a latch member 70 which protrudes outwardly between rails 67 and 68 and rides on a latch shaft 72. A compression spring 74 urges latch 70 toward rail 67. Latch 70 has a beveled end and a side recess 73. The purpose of latch 70 is to engage the shuttle when it is received in the carrier from one belt drive and hold it in position until the carrier has reached the end of its vertical travel and is ready to release the shuttle to the next belt drive. For this purpose, the shuttle has two latch pins 62, one at each end of the shuttle, to engage a latch at the end of its travel in either direction. FIG. 8 shows carrier 35 in phantom lines with latch 70 in position to engage a latch pin 62. The distal end of latch 70 is beveled to allow the latch pin to slide along its beveled surface, moving the latch aside and then engaging recess 73.

Motor and control housing 56 contains a flat motor and also a control module which controls the unwinding speed of the motor. The unwinding speed determines the amount of tension on the film being dispensed and, therefore, the amount of stretching of the film as the film is wrapped around the coil. Normally, roll 61 of the film carries enough film to wrap several coils, depending on the sizes of the coils and recognizing that two rolls of film are being dispensed in each wrapping operation. In order for the motor speed to be adjusted properly for each coil, it is desirable to measure the outer diameter of the film roll before commencing a wrapping operation and to provide this diameter information to the motor control. This measurement can be made manually or automatically using, for example, an optical measuring device. The information can then be supplied to the motor control either manually or automatically.

FIG. 2 illustrates a typical range of sizes of coils which can be handled by the mechanism of the present invention. The diameter of the eye 12 of a coil which can be handled by the present machine can vary between about 20 and 24 inches and the elevation of the center of the eye is variable over a range of more than 20 inches. This range is important because the wrapping frame must be adjustable to the proper level of the eye in order to insert assembly 27. The machine is designed to handle a coil having an outside diameter as small as 36 inches. The maximum size coil which this machine is designed to handle is about 72 inches in diameter. The machine can wrap coils having an axial length between about 24 inches and 72 inches. These dimensions are selected to accommodate common coil sizes but are only illustrative because a machine can be built using the principles of the invention to wrap larger or smaller coils.

Figure 11:
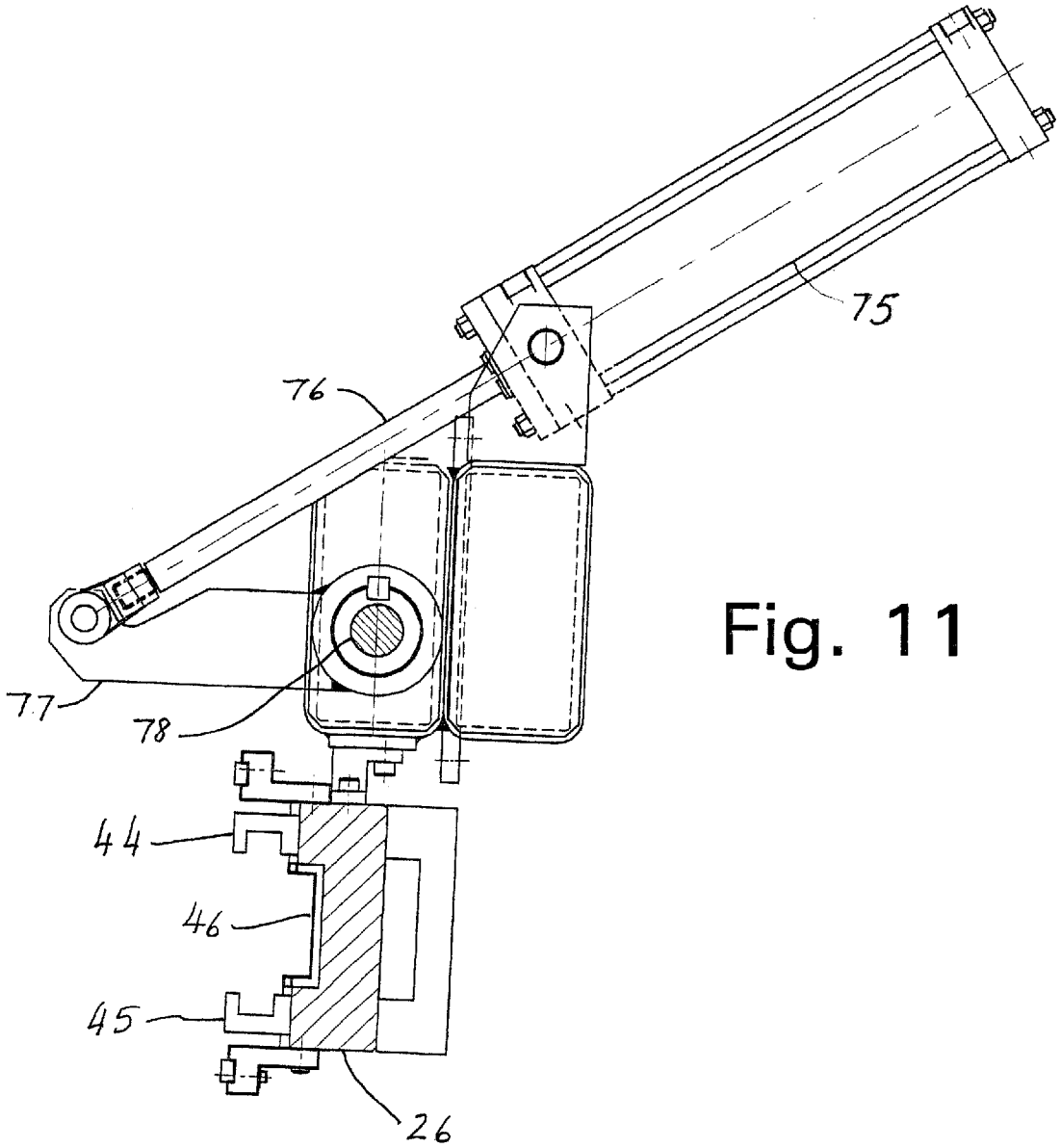
FIG. 11 is an enlarged partial view of the vertical transfer assembly pivoting mechanism.

The mechanism for lifting and lowering assembly 29 between the loading position and the wrapping position is also shown in FIGS. 2 and 3 and the pivot mechanism is shown at a larger scale in FIG. 11. A hydraulic or pneumatic cylinder 75 is mounted on one of side walls 22 and has an operating rod 76 which is connected to a lever arm 77 attached to a rotatable shaft 78. The upper end of assembly 29 is supported on and keyed to-shaft 78 which is rotatable relative to adjacent side wall 22. A latch mechanism includes a pressure cylinder 79 having an operating rod connected to a clamp arm 81 which is movable between an open position, illustrated in FIG. 3, and a latched position shown in FIG. 2. Clamp arm 81 carries a clamp strap 83 which, in the closed position, holds an end of transfer assembly 27 between the clamp strap and the back of vertical transfer assembly 29, thereby securely holding the pivotable vertical transfer assembly against assembly 27. To open the wrapping frame, cylinder 79 is operated to pull clamp strap 83 and clamp arm 81 away from transfer assembly 27, thereby freeing assembly 29 to move. cylinder 75 is then actuated to withdraw its operating rod, swinging assembly 29 to the position shown in FIG. 2.

While certain advantageous embodiments have been chosen to illustrate the invention, it will be understood by those skilled in the art that various modifications can be made therein without departing from the scope of the invention as defined in the appended claims.

We claim:

1. A wrapping machine for wrapping a generally toroidal body having an opening therethrough with an elongated length of wrapping material, the machine comprising the combination of means for supporting a body to be wrapped with a central axis of said opening through said body in a predetermined position;

at least one shuttle for carrying a spool of wrapping material and for the controlled dispensing of said wrapping material;

a wrapping frame having four separate transfer assemblies arranged in a generally rectangular array, one of said transfer assemblies being positionable through said opening in said body, said transfer assemblies including first and second transfer assemblies each comprising rail means for receiving said at least one shuttle at one end and conveying said shuttle from said one end to an opposite end, said first and second transfer assemblies being positioned at opposite sides of said rectangular array, third and fourth transfer assemblies each having a separate shuttle carrier and means for conveying said shuttle carrier from one end of said transfer assembly to the other end thereof, said third and fourth transfer assemblies being positioned at opposite sides of said rectangular array and interconnecting ends of said first and second transfer assemblies;

said shuttle carriers each being adapted to receive a shuttle from said rail means of one of said first and second transfer assemblies, carry said shuttle along the length of one of said third and fourth transfer assemblies and release said shuttle to said rail means of the other of said first and second transfer assemblies for conveyance to said carrier on the other one of said third and fourth transfer assemblies while dispensing wrapping material to wrap said coil.

2. A machine according to claim 1 comprising a support for said frame, said support being horizontally movable to move said frame toward and away from a body to be wrapped.

3. A machine according to claim 1 wherein two of said transfer assemblies lie in a substantially vertical plane.

4. A machine according to claim 1 wherein said third and fourth transfer assemblies lie in a substantially vertical plane with upper ends thereof connected to opposite ends of an upper one of said first and second transfer assemblies, one of said third and fourth transfer assemblies being pivotable about a location at the upper end thereof to open one end of said rectangular array whereby a lower one of said first and second transfer assemblies is insertable through said eye of said body.

5. A machine according to claim 4 including latch means for selectively holding said pivotable one of said third and fourth assemblies in a closed position.

6. A machine according to claim 1 wherein said at least one shuttle includes a plurality of wheels in sets of three, each said set including two wheels rotatable about parallel axes and a third wheel rotatable about an axis perpendicular to said two wheels.

7. A machine according to claim 6 wherein said rail means includes first and second elongated rails each having a generally U-shaped cross-section, said U-shaped cross-sections of said first and second rails facing inwardly toward each other, and wherein said shuttle has a base portion lying between said first and second rails with wheels of each said set of wheels in rolling contact with three inwardly facing surfaces of said rails.

8. A machine according to claim 7 wherein said shuttle comprises a motor and control housing and a spindle coupled to a shaft of said motor for replaceably receiving a spool of wrapping material.

9. A machine according to claim 8 wherein each said shuttle carrier includes carrier rails having U-shaped cross-sections matching said cross-sections of said first and second rails so that, when a shuttle carrier is moved to an end of one of said first and second transfer assemblies, a shuttle is movable to and from a carrier with said sets of wheels in rolling contact with said carrier rails.

10. A machine according to claim 9 wherein each said carrier includes a spring-urged latch between said rails and said shuttle includes a latch pin engaged by said latch when a shuttle enters a carrier.

11. A machine according to claim 1 wherein said first and second transfer assemblies include belt drives for conveying said shuttles.

12. A machine according to claim 11 wherein said third and fourth transfer assemblies comprise linear actuators for conveying said carriers.

13. A machine according to claim 1 including two shuttles movable concurrently along said transfer mechanisms and concurrently wrapping a coil.

* * * * *

UNITED STATES PATENT AND TRADEMARK OFFICE

CERTIFICATE OF CORRECTION

PATENT NO. : 6,324,820 B1 
DATED : December 4, 2001
INVENTOR(S) : Roman Gelfman, Chris Spanakos and Melvin G. Parnes It is certified that error appears in the above-identified patent and that said Letters Patent is hereby corrected as shown below:

Title page,
Item [75], Inventors: the name of "Spanakos Chris" has been transposed, correct to read -- Chris Spanakos --;

Column 2,
Line 29, please delete "-" and insert therefor a space;

Column 6,
Line 13, please delete "-" and insert therefor a space.

Signed and Sealed this

Thirtieth Day of July, 2002

*Attest:*

*Attesting Officer*

JAMES E. ROGAN
*Director of the United States Patent and Trademark Office*